United States Patent [19]

Lower et al.

[11] Patent Number: 4,523,897

[45] Date of Patent: Jun. 18, 1985

[54] TWO STAGE VACUUM PUMP

[75] Inventors: Ralph C. Lower, Bryan; Gary P. Murray, Montpelier, both of Ohio

[73] Assignee: Robinair Division, Montpelier, Ohio

[21] Appl. No.: 630,351

[22] Filed: Jul. 16, 1984

Related U.S. Application Data

[63] Continuation of Ser. No. 387,620, Jun. 11, 1982, abandoned.

[51] Int. Cl.[3] ..... F04B 23/04; F04C 25/02

[52] U.S. Cl. ..... 417/244; 418/13; 418/238; 418/269

[58] Field of Search ..... 418/13, 238, 236, 86, 418/269; 417/244

[56] References Cited

U.S. PATENT DOCUMENTS

| | | | |
|---|---|---|---|
| 2,588,430 | 3/1952 | Svenson | 418/77 |
| 4,137,018 | 1/1979 | Brucken | 418/238 |
| 4,283,167 | 8/1981 | Bassan et al. | 418/13 |

*Primary Examiner*—Cornelius J. Husar
*Assistant Examiner*—Peter M. Cuomo
*Attorney, Agent, or Firm*—Beaman & Beaman

[57] ABSTRACT

The invention pertains to a two stage vacuum pump particularly suitable for servicing refrigeration systems wherein a pair of electrically driven rotors support outwardly movable vanes engaging the cylindrical circumference of pumping chambers in which the rotors are mounted. The efficient relationship of components produces a high capacity pump in a concise configuration, lateral sides of the rotors are recessed to produce rapid seating of the vanes, reduce hydraulic end loading of the second stage rotor and minimize friction. The vanes are offset from the associated rotor axis to allow greater displacement for a given chamber bore and rotor size, and advantageous frictional forces are produced to augment sealing between the vane tips and chamber surface. Further, the vane tips are shaped to optimize compression and reduce gas re-expansion, and the rotors of the two stages are rotationally phased to improve capacity and pumping characteristics.

1 Claim, 7 Drawing Figures

TWO STAGE VACUUM PUMP

BACKGROUND OF THE INVENTION

Vacuum pumps are widely used in the servicing of refrigeration circuits as such circuits must be evacuated of air prior to being charged with refrigerant. A variety of commercially available pumps for such purpose are available, such as shown in assignee's U.S. Pat. Nos. 3,791,780; 3,837,764; 3,982,864; 4,295,794 and 4,120,621, and it is known to incorporate multiple pumping stages into such pumps connected in series wherein a high vacuum may be produced. Such pumps use various types of pumping elements, such as pistons, lobes, eccentric rotors, vanes and the like.

In the evacuation of refrigeration circuits, the vacuum pump must handle the lubricant which is used within the circuit to lubricate the compressor, and vacuum pumps usually operate within an oil reservoir for lubrication, sealing and heat dissipation purposes.

An object of the invention is to provide a concise, economical, relatively light weight, rugged, dependable vacuum pump having a long effective wear life and capable of drawing a relatively high vacuum at acceptable pumping capacities particularly suitable for refrigeration servicing purposes.

Another object of the invention is to provide a two stage electrically driven vacuum pump employing outwardly movable vanes within rotors wherein end loading on the second stage rotor is reduced and frictional resistance of rotor rotation is minimized.

Another object of the invention is to provide a two stage vacuum pump using rotor mounted vanes within cylindrical pumping chambers wherein the configuration of the vane tip engaging the chamber is matched to the chamber bore to provide superior compression and gas re-expansion characteristics.

A further object of the invention is to provide a two stage vacuum pump wherein the pumping elements are assembled as a readily replaceable module for ease of assembly and maintenance wherein a pump module can be replaced in the field by relatively inexperienced service personnel.

Another object of the invention is to provide a two stage vacuum pump utilizing rotors each supporting two movable vanes engaging a pumping chamber surface, the rotors being mounted within vane slots which are parallel but radially offset from the associated rotor axis wherein greater displacement is achieved for given rotor and chamber sizes.

An additional object of the invention is to provide a two stage vacuum pump utilizing a pair of rotors mounted upon a common driven shaft, the vanes mounted upon the rotors being rotationally offset with respect to each other about the shaft axis to improve free air capacity and pumping speeds.

In the practice of the invention an electric motor is mounted to a cast pump housing having a handle extending from the upper region thereof wherein the vacuum pump is readily portable and easily handled. Within the pump housing a pump module is located having a shaft in driven relationship with the electric motor shaft, and the housing is partially filled with oil for lubrication, sealing and cooling purposes. The housing is provided with fins to aid in the dissipation of heat.

A pair of cylindrical pumping chambers are defined within the module separated by a center divider valve plate, and a rotor is mounted within each chamber upon the module shaft. The rotors are of a cylindrical form concentric to the associated shaft, and the shaft is eccentrically related to the axis of the pumping chambers. Each rotor includes a pair of parallel slots each intersecting the associated rotor axis, but offset with respect to the rotor axis, and extending toward the rotor circumference in opposite directions intersecting the rotor circumference at diametrical locations.

A flat vane is slidably received within each rotor slot having a tip which engages the associated chamber circumference. The vane tips are matched to the chamber inner diameter, and the rotors are rotationally phased with respect to each other, approximately 20°, to improve free air capacity and pumping speed.

Both sides of the second stage rotor are recessed, the associated vane slots communicating with such recesses, and the side of the first stage rotor adjacent the center divider valve plate is also recessed. These recesses interconnect with the crossover porting between the stages and equalizes pressure below all of the vanes which allows the vanes to rapidly seat during start-up, and the recesses also reduce the hydraulic end loading on the second stage rotor, and minimize the friction between the rotors and the module plates.

The end of the pumping module disposed adjacent the pump housing removable end cover plate is closed by a pump face plate having a port communicating with an inlet fitting which is connectable to the refrigeration circuit. The opposite end of the pumping module is enclosed by an exhaust end plate having a valved orifice defined therein whereby the pump's exhaust passes into an exhaust chamber, and through an oil baffle for exhausting through the hollow handle mounted upon the pump housing and the pump can be readily positioned such that the discharge is directed away from the service personnel.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
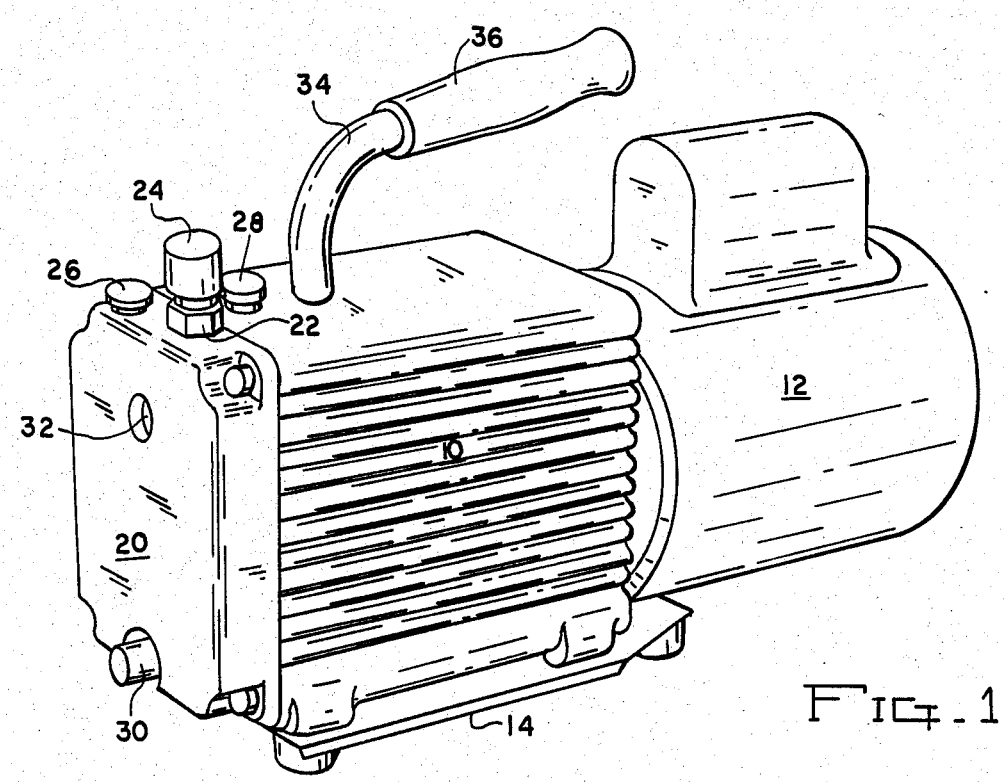
FIG. 1 is an elevational, perspective view of a two stage vacuum pump in accord with the invention.

As will be appreciated from FIG. 1, the vacuum pump in accord with the invention includes a cast pump housing 10 to which is mounted an electric motor 12. The entire unit is mounted upon a base plate 14 which encloses the underside of the housing and resilient legs 16 are attached to the plate for supporting the unit. The motor attaches to one end of the housing 10 by screws 18, FIG. 2, and the other end of the pump housing is enclosed by the end cover 20 which is of a cast fabrication. Externally, the cover includes an inlet fitting 22 which is of a conventional threaded configuration to which a flexible hose may be attached for establishing communication with the refrigeration circuit to be evacuated. A removable cap 24 is threaded upon the fitting when the pump is not in use to prevent the entrance of foreign matter into the pump. A gas ballast valve 26 is mounted upon the cover for regulating the pump ballast, and an oil fill plug 28 is threadedly received within the pump housing to permit the housing to be supplied with oil. Oil is drained through the drain valve 30, and the oil level within the housing is visible through the sight glass 32 defined in the cover 20.

A handle 34 is threaded into the upper surface of the pump housing and is provided with a hand grip 36 for readily carrying the unit. The handle 34 comprises an exhaust conduit, as is later described, through which the pumped refrigerant is expelled.

Figure 2:
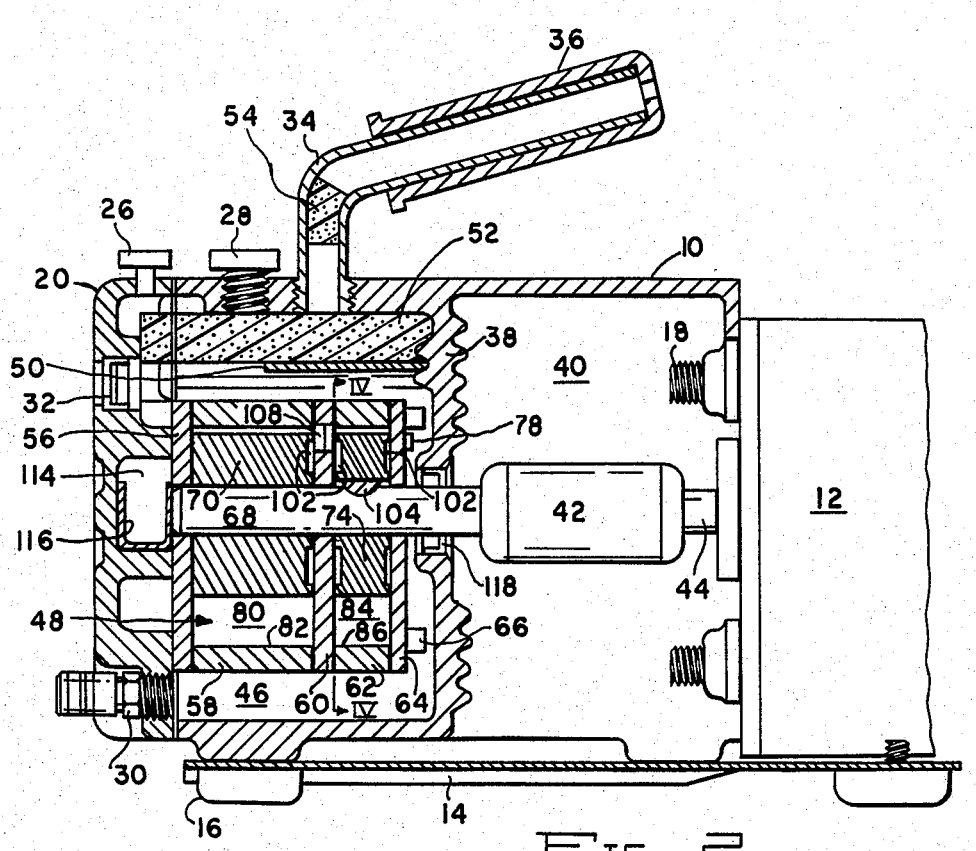
FIG. 2 is a diametrical, elevational, sectional view of the pump housing.

As will be appreciated from FIG. 2, the housing 10 is divided into two compartments by the inner wall 38. The compartment 40 is enclosed at its lower region by the base plate 14, and serves to house the coupling 42 mounted upon the end of the motor shaft 44. Removal of the base plate provides access to the coupling.

The housing compartment 46 houses the pump module, generally indicated at 48, and also includes the baffle plate 50, and the oil baffle 52. The upper region of the compartment 46 communicates with the handle 34 and a second oil baffle 54 is located within the handle. The compartment 46 is filled with oil to the midpoint of the sight glass 32, and as apparent from FIG. 2, the drain valve 30 communicates with the lower region of the compartment.

The pump module 48 is of a rectangular block configuration and includes the rectangular inlet face plate 56, the first stage pump section block 58, the center divider valve plate 60, the second stage pumping section block 62, and the exhaust end plate 64. These components are maintained in assembled relationship to the end cover 20 by four bolts 66, FIG. 3, extending through holes defined in the plates and blocks. Internally, the pump module includes shaft 68 rotatably mounted upon plates 56, 60 and 64, and keyed to the shaft is the first stage rotor 70 supporting its vanes 72, located within the block 58, and the second stage rotor 74 with its vanes 76 is located within the block 62. A reed valve 78 is mounted upon the exterior of the exhaust plate 64.

A pumping chamber is defined within each of the blocks 58 and 62. The first stage pumping chamber 80 is of a cylindrical configuration defined by cylindrical surface 82, and likewise the second stage pumping chamber 84 is defined by cylindrical surface 86. As will be appreciated from FIGS. 2 and 4, the shaft 68 is eccentrically related to the center of the pumping chambers 80 and 84, but the cylindrical rotors 70 and 74 are concentrically mounted upon the shaft.

The axial width of the first stage block 58 and rotor 70 is greater than the axial dimension of the second stage block 62 and rotor 74 in view of the greater volume desired within the first stage pumping chamber.

The rotors 70 and 74 are identical with respect to the support of their associated vanes. Each rotor is provided with a pair of slots 88 and 90, FIG. 4, which intersect the lateral sides of the associated rotor and also intersect the cylindrical periphery thereof. The slots are parallel to each other, each being defined by an inner surface 92 and a parallel outer surface 94. The slot 88 and 90 are not radial, but are offset with respect to the axis of the associated rotor and shaft 68, and the slots intersect the associated rotor circumference at diametrically opposite locations. The rotors and shaft 68 rotate clockwise as viewed in FIG. 4.

Figure 4:
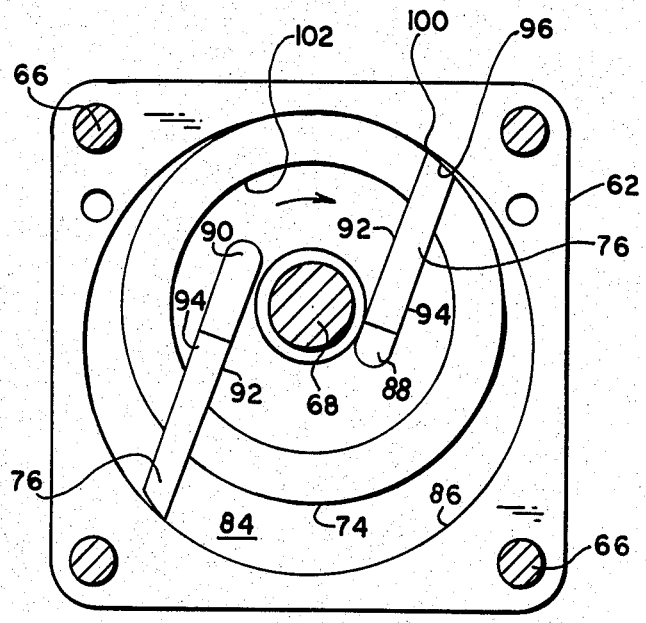
FIG. 4 is an elevational, section view taken through a pumping chamber as along Section IV—IV of FIG. 2.
Figure 5:
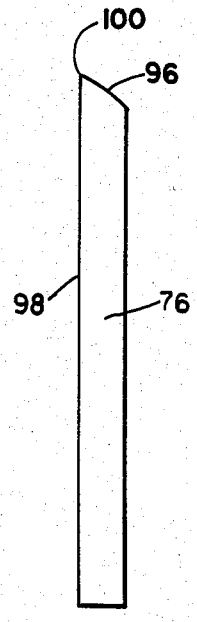
FIG. 5 is an end elevational view of a rotor vane constructed in accord with the invention.

The vanes located within the rotors 70 and 74 are identical, except that the vanes within rotor 70 are of a greater width than those supported within the second stage rotor 74. The vanes are of a width corresponding to the width of the associated rotor, and associated pumping chamber, and the vanes are of a flat plate configuration having a length which permits the vane to extend from the associated rotor the maximum extent required during each pumping rotation while still being adequately supported by the associated rotor, and each vane is formed with a shaped tip which engages the associated chamber cylindrical surface. As best appreciated from FIG. 5, the tip of the vanes includes a cylindrical segment 96 intersecting the trailing vane side 98 which engages the associated slot inner surface 92. In this manner the vane tip includes a trailing edge 100 defining the maximum extension of the vane. The vane cylindrical segment 96 is of a radius equal to the radius of the associated pumping chamber surface 82 or 86, and the center of the segment 96 substantially coincides with the center of the associated chamber surface when the vane is retracted its maximum extent due to engagement with the chamber surface during the final stage of exhausting of the pump chamber, i.e. when the vane tip is substantially at the "top" of the rotor as represented in FIG. 4. Thus, at this time, substantially the entire surface of the vane tip segment 96 will be in engagement with the chamber cylindrical surface and optimum compression is achieved while simultaneously reducing the likelihood of gas re-expansion.

The offsetting of the vane slots, and vanes, as shown in FIG. 4, permits a greater displacement for a given chamber and rotor size than a radial vane slot arrangement in that it allows a greater vane stroke during each rotor revolution. Further, sealing at the vane tip is improved due to the increased frictional drag on the sides of the vane.

Figure 3:
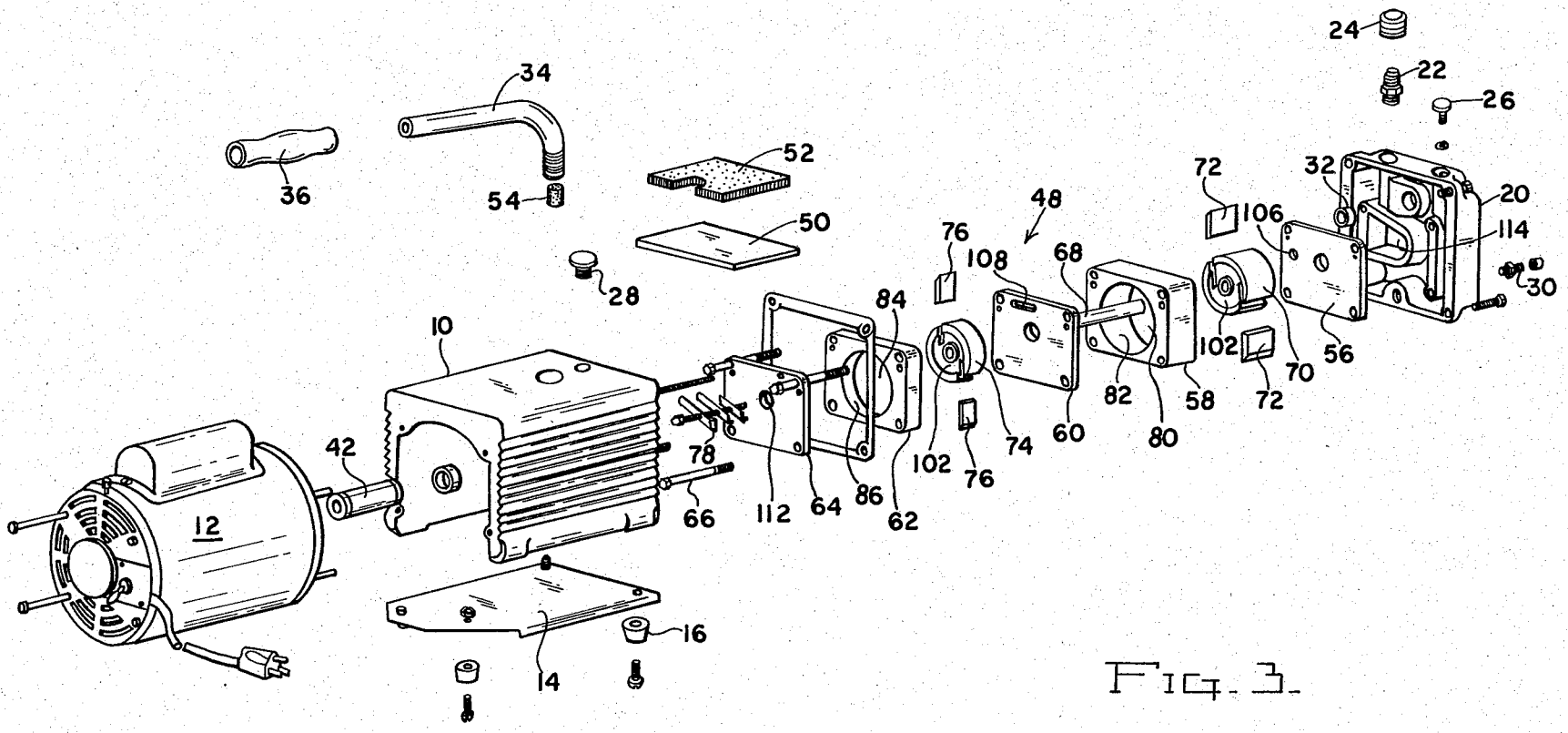
FIG. 3 is an exploded, perspective view of the pump in accord with the invention illustrating the components thereof.

To improve the time required to initially seat the vanes against the associated chamber circumference when the pump is started, and in order to reduce the hydraulic end loading on the second stage rotor 74 while reducing the frictional forces on the rotors due to engagement with the adjacent lateral plates, both sides of the second stage rotor 74, and the side of the first stage rotor 70 adjacent the valve plate 60 are recessed at 102 as apparent from FIGS. 2 and 3. The recesses 102 occur slightly inwardly of the outer periphery of the rotors, and do not extend all the way to the shaft, whereby a hub projection is defined adjacent the shaft. As apparent from FIG. 3, the vane slots 88 and 90 intersect the rotor recesses 102, and the rotor recesses interconnect with the crossover porting within the center divider valve plate 60. Thus, the recesses are exposed to the pressure within the pumping module, and pressure entering the vane slots will tend to force the vanes outwardly into engagement with the associated pumping chamber surface 82 or 86. As both sides of the second stage rotor 74 will be exposed to an equal pressure sure due to communication of both sides of the rotor with the vane slots hydraulic end loading on the second stage rotor is equalized, and further, as the recesses 102 reduce the area of the sides of the rotors which engage the associated center valve plate 60 and exhaust plate 64 frictional resistance to rotor rotation will be reduced.

The rotors 70 and 74 are keyed to the shaft 68, the key 104 for the second stage rotor being shown in FIG. 2, and preferably, the rotors 70 and 74 are keyed to the shaft out of rotational phase with respect to each other, preferably being rotationally offset approximately 20°, which causes the compression and exhaust cycle of one rotor to slightly lag the other, preventing an accumulation of pulse forces and drag upon the motor, and this rotational phasing of the rotors optimizes the free air capacity of the pump, and permits the maximum pumping speed to be maintained.

Figure 6:
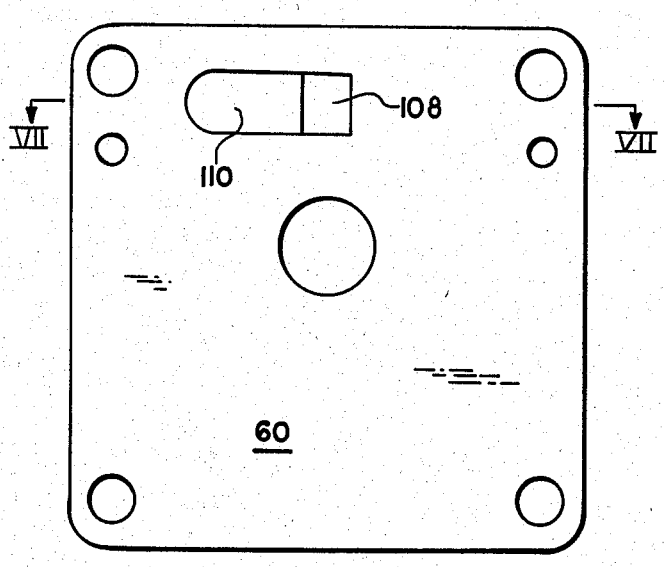
FIG. 6 is an elevational view of the center divider valve plate.
Figure 7:
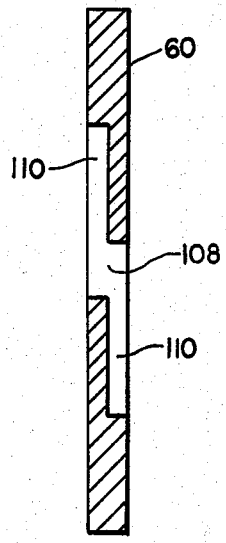
FIG. 7 is a sectional view of the valve plate of FIG. 6 as taken along Section VII—VII of FIG. 6.

Inlet gases enter the pumping module 48 through the port 106 defined in the inlet plate 56, FIG. 3. The first and second pumping chambers communicate through the port 108 defined in the center divider valve plate 60, FIG. 6. The port 108 includes extensions 110 defined in the plate sides wherein communication with the port 108 occurs during several degrees of rotation of the rotors. The exhaust plate 64 includes the exhaust port 112, and this port is closed by the reed valve 78 assuring unilateral flow through the port 112 into the pump housing compartment 46.

As apparent in FIGS. 2 and 3, the end cover 20 includes an inlet chamber 114 having a screen 116 located therein. The inlet port 106 communicates with the chamber 114 and the chamber also communicates with the inlet fitting 22 through a passage defined in the cover. The screen 116 prevents foreign matter from entering the inlet chamber.

The pumping module shaft 68 is connected to the motor coupling 42, and seal 118 prevents the loss of oil from the compartment 46 at shaft 44. The cover 20 is mounted to the housing 10 by screws, FIG. 3, and upon removal of the screws the cover 20, and pump module 48, can be readily removed from the housing.

In use, the inlet fitting 22 is connected to a conduit, usually a hose fitting, which communicates with the refrigeration system to be evacuated. Upon energization of the motor 12, the refrigerant will be drawn from the inlet chamber 114 through port 106 into the first stage chamber 80. Rotation of the rotor 70 forces the refrigerant through the valve plate 60 into the second chamber 84, and the gas passes through the exhaust port 112 into the compartment 46. The evacuated refrigerant passes through the oil baffles 52 and 54 and is exhausted through the open end of the handle 34. As the discharge through the handle is directional, the pump may be readily positioned to direct the refrigerant discharge away from service personnel. The baffles prevent oil from being forced through the discharge handle and the pump is operated until the desired vacuum is achieved.

From the above it will be appreciated that the two stage vacuum pump of the invention is concise, readily portable, easily serviced, and the pump module may be readily replaced in its entirety in the field. Further, the recesses on the rotors provide improved operating characteristics as does the orientation of the vanes and the configuration of the vane tips, and the phasing of the first and second stage rotors additionally provides improved capacity and pump operation for the size of the apparatus. It will be appreciated that various modifications to the inventive concepts may be apparent to those skilled in the art without departing from the spirit and scope of the invention.

We claim:

1. A two stage rotary vacuum pump including a pump module having first and second pumping chambers defined therein each having a cylindrical circumference, a rotor shaft rotatably mounted within the module extending through the chambers and eccentrically related thereto, an electric motor drivingly connected to the rotor shaft, first and second rotors each having an axis, lateral sides, and fixed to the shaft located within the first and second chambers, respectively, at least one non-radial vane movably mounted in each rotor extending from the periphery thereof having an outer end engaging the associated chamber circumference and translatable between extended and retracted positions, the vane being in a gas compression exhausting position at its retracted position and the outer end having trailing and leading edges with respect to the direction of rotor rotation, a valve plate located intermediate the rotors having a port defined therein establishing communication between the chambers at predetermined rotational positions of the rotors, an exhaust plate disposed adjacent the second rotor having an exhaust port defined therein selectively communicating with the second chamber at a predetermined rotational position of the second rotor, the improvement comprising, each of the rotors including a cylindrical circumference and lateral sides radially perpendicular to the rotor shaft, the lateral side of the first rotor adjacent the valve plate and both lateral sides of the second rotor being recessed intermediate the associated rotor circumference and the rotor shaft, an annular hub defined upon the recessed lateral sides of the rotors adjacent the rotor shaft, the rotor recesses being of an annular configuration and located intermediate the associated rotor circumference and hub, a slot defined in each rotor intersecting the associated rotor lateral side recesses, the rotor vane being slidably mounted within said slot, the port within the valve plate communicating with said rotors' recesses whereby fluid pressure within the second chamber biases the vanes toward the chambers' circumferences and hydraulic axial forces upon the second rotor are substantially balanced, the vanes' outer ends comprising a cylindrical segment surface having a radius substantially equal to the radius of the associated chamber circumference and having a center coinciding with the axis of the associated chamber at the vanes' retracted position whereby the entire outer ends of the vanes engage the chamber circumference at the termination of the compression cycle at the vanes' retracted position to produce optimum compression and reduce the likelihood of gas re-expansion, the valve intermediate the rotors comprising a relatively thin plate and including first and second parallel sides, said first side defining a portion of the first chamber and said second side defining a portion of the second chamber, said valve plate port comprising a first recess defined in said valve plate intersecting said first side, a second recess defined in said valve plate intersecting said second side and an axial passage defined in said valve plate directly intersecting said valve plate sides and communicating with said recesses, said recesses being elongated in the direction of rotor rotation and offset with respect to each other in the direction of rotor rotation, said passage being located centrally with respect to said recesses in the direction of rotor rotation.

* * * * *